US009249636B2

(12) United States Patent
Havinga et al.

(10) Patent No.: US 9,249,636 B2
(45) Date of Patent: Feb. 2, 2016

(54) COILED TUBING INJECTOR ASSEMBLY

(75) Inventors: Richard Havinga, Okotoks (CA); Layden Reginald, Calgary (CA)

(73) Assignee: Xtreme Drilling and Coil Services, Inc., Calgary (CA)

( * ) Notice: Subject to any disclaimer, the term of this patent is extended or adjusted under 35 U.S.C. 154(b) by 32 days.

(21) Appl. No.: 13/581,840

(22) PCT Filed: Mar. 3, 2011

(86) PCT No.: PCT/IB2011/001059
§ 371 (c)(1),
(2), (4) Date: Nov. 14, 2012

(87) PCT Pub. No.: WO2011/107889
PCT Pub. Date: Sep. 9, 2011

(65) Prior Publication Data

US 2013/0048270 A1 Feb. 28, 2013

Related U.S. Application Data

(60) Provisional application No. 61/310,099, filed on Mar. 3, 2010.

(51) Int. Cl.
*E21B 19/22* (2006.01)

(52) U.S. Cl.
CPC ..... *E21B 19/22* (2013.01)

(58) Field of Classification Search
USPC ..... 166/66, 77.3, 77.1; 175/162, 203
See application file for complete search history.

(56) References Cited

U.S. PATENT DOCUMENTS

| | | | | |
|---|---|---|---|---|
| 5,775,417 | A * | 7/1998 | Council | 166/77.3 |
| 2003/0233873 | A1* | 12/2003 | Standen | 73/152.48 |
| 2008/0296013 | A1* | 12/2008 | Pleskie | 166/77.3 |
| 2008/0314413 | A1* | 12/2008 | Wetzel et al. | 134/22.18 |

* cited by examiner

*Primary Examiner* — David J. Bagnell
*Assistant Examiner* — Taras P Bemko
(74) *Attorney, Agent, or Firm* — Bushman Werner, P.C.

(57) ABSTRACT

A coiled tubing injector assembly having an arch for guiding coiled tubing into the injector and, including an injector selectively engageable with coiled tubing for forcing the coiled tubing through the injector in an upward or downward direction. There is also an injector mount and the injector is interconnected to the mount via a plurality of load cells, such that any forces exerted on the injector by flexing or twisting of the arch and/or coiled tubing guided by the arch are detected by the load cells.

8 Claims, 2 Drawing Sheets

COILED TUBING INJECTOR ASSEMBLY

CROSS-REFERENCE TO RELATED APPLICATION

This application is a national phase of International Application PCT/IB2011/001059 which claims priority to U.S. Provisional Application No. 61/310,099 filed on Mar. 3, 2010, the disclosures of which are incorporated herein by reference for all purposes.

FIELD OF THE INVENTION

The current invention relates to a coiled tubing injector and, more particularly, to a mounting arrangement for a coiled tubing injector of the type used for inserting and withdrawing coiled tubing into and out of a well bore.

BACKGROUND OF THE INVENTION

The use of coiled tubing injectors for drilling oil and gas well has risen dramatically in recent years. More particularly, the use of coiled tubing injectors in the use of directional drilling has gained widespread acceptance.

In the drilling of vertical, directional, or horizontal wells, there is a need for accurately controlling the weight on the drill bit (WOB). Accurate control of WOB is particularly critical when either directional or horizontal wells are being drilled. In directional or horizontal wells, the weight on the drill bit affects the angular deviation of the drill hole away from the vertical. By obtaining an accurate time measurement of the duration of travel of the rotary bit within the well bore, together with providing a way of accurately limiting the loads that are placed on the drill bit, it is possible to execute delicate and sophisticated drilling operations while minimizing downhole tool failures and maximizing the life of the drill bits.

U.S. Patent Publication 2008/0296013 ('013 Publication), incorporated herein by reference for all purposes, discloses a top mounted injector for coiled tubing injection comprising an injector supported from a mounting component in a support system e.g. a mast, the mounting component including a carrier which is engageable with the mast for transferring to the mast the forces exerted on the mounting component from the injector component during the injection and withdrawal of tubing by the injector component. The '013 Publication discloses a strain gauge deployed between the injector and the mounting component for providing continuing indication of the forces developed in injecting or withdrawing the tubing from the borehole and consequently the force transferred between the injector to the mast through the mounting component. However, in the arrangement shown in the '013 Publication, vis-à-vis determining accurate WOB, the arrangement in the '013 Publication suffers from the fact that the injector is suspended via one strain gauge and a hinge.

SUMMARY OF THE INVENTION

In accordance with one aspect of the present invention, there is provided a coiled tubing injector assembly mounted in a mast or other support which permits more accurate determination of WOB.

In another aspect of the present invention, there is provided a coiled tubing injector assembly, including a coiled tubing injector, an injector mount and load cells, particularly in the form of load cell pins, interconnecting the mount and the injector.

The coiled tubing injector system of the present invention can comprise a coiled tubing injector having a guide arch and a mount, the injector being interconnected to the mount by at least two load cells. The load cells are positioned between the injector and the mount, such that any forces exerted on the injector by flexing or twisting of the guide arch and/or coiled tubing guided by the arch are detected by the load cells and subsequently accounted for so that an accurate WOB measurement is achieved.

DESCRIPTION OF PREFERRED EMBODIMENTS

In prior art coiled tubing injector systems, load cells are commonly used to measure WOB. However, with these prior art systems, WOB is rarely accurate because the goose neck or guide arch on the injector exerts forces on the injector, which affects the reading of the load cells. In particular, as tubing is spooled from the storage reel into the wellbore, it exerts a force which tries to pull the guide arch toward the injector. However, the guide arch effectively acts as a lever exerting a counter-upward pull. Accordingly, as coiled tubing is unspooled from the reel, the load fluctuates and it is not uncommon for the load cell readings to go from positive to negative quickly, thus rendering the measurement of WOB inaccurate if not meaningless. The above problem is solved by the present invention.

Figure 2:
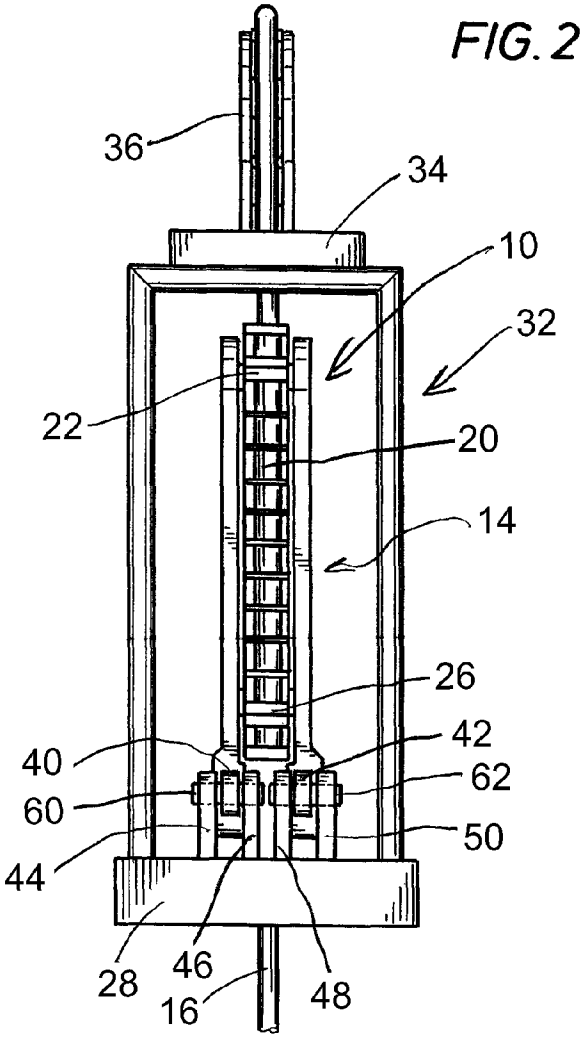
FIG. 2 is an elevational side view of the embodiment shown in FIG. 1.
Figure 1:
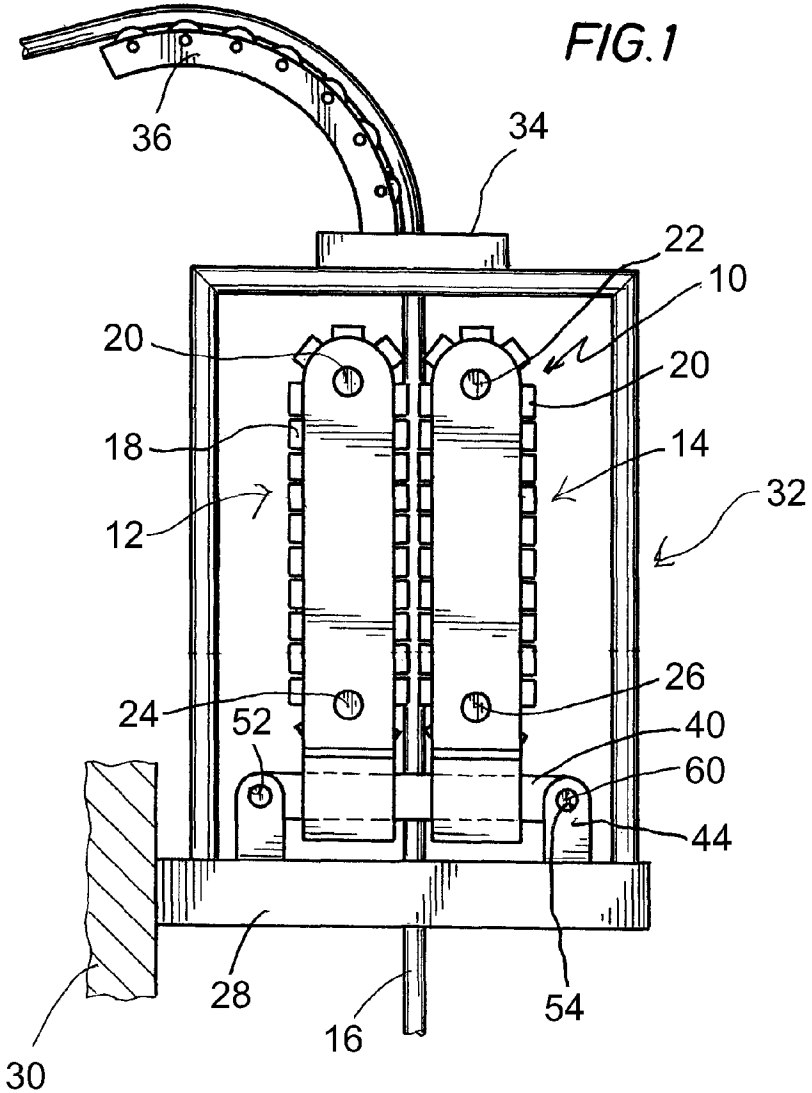
FIG. 1 is an elevational view of one embodiment of the present invention.

Referring first to FIGS. 1 and 2, there is shown one embodiment of the present invention wherein the coiled tubing injector is bottom mounted. The coiled tubing injector, shown generally as 10, includes a pair of continuous linked drive chains, 12 and 14, having opposed flights on opposite sides of the passage of the coiled tubing 16 therebetween. As is well known to those skilled in the art, the drive chains 12, 14 carry a series of gripping blocks 18, 20, respectively, to grip the coiled tubing, as it is injected into or pulled from the well. The chains 12, 14 are driven by a pair of upper, drive sprockets 20 and 22, respectively. Chains 12, 14 are also rotably mounted on lower, idler sprockets 24 and 26, respectively.

The injector mount comprises a base 28 having an upwardly extending frame 32 attached thereto, base 28 being supported on a mast or the like, a portion of which is shown as 30.

As can be seen, mount 28 comprises part of a generally rectangular frame, shown generally as 32. Frame 32 has a top portion 34, to which is connected a guide arch 36, well known to those skilled in the art.

As best seen in FIG. 2, injector 10 is connected to spaced beams 40 and 42 in a manner described hereafter. Extending upwardly from base 28 are eye brackets 44, 46, 48 and 50. Eye brackets 44-50 have eyes or holes therethrough, which are in register. In like fashion, beams 40 and 42 have spaced apertures which are in register with the eyes in brackets 44-50. As can be seen in FIG. 1, beam 40 has one such aperture 52 and a second such aperture 54. It will be appreciated that beam 42 is of like construction. When beams 40 and 42 are properly positioned, the eyes in brackets 40-50 are in register with the apertures in the beams 40, 42. With reference to FIG. 1, it can be seen that beam 40 has a first aperture 52 and a second aperture 54. Received in the eyes of brackets 44 and 46 and the aperture 54 in beam 40 is a load cell in the form of a load pin 60. In like fashion, a second load pin 62 is received in the eyes of brackets 48 and 50, and the registering aperture in beam 42. It will also be appreciated, as can be seen from FIGS. 1 and 2, that beams 40 and 42 are interconnected to eye brackets on both ends in the manner shown in FIG. 2. In other words, there are four load pins interconnecting injector 10 via the beams 40 and 42 to mount or base 28 by virtue of eight eye brackets, four of which are shown as 44-50 by means of four load pins, two of which are shown as 60 and 62. Accordingly, any weight or force on injector 10, including string weight downhole is transmitted to the load pins.

Figure 3:
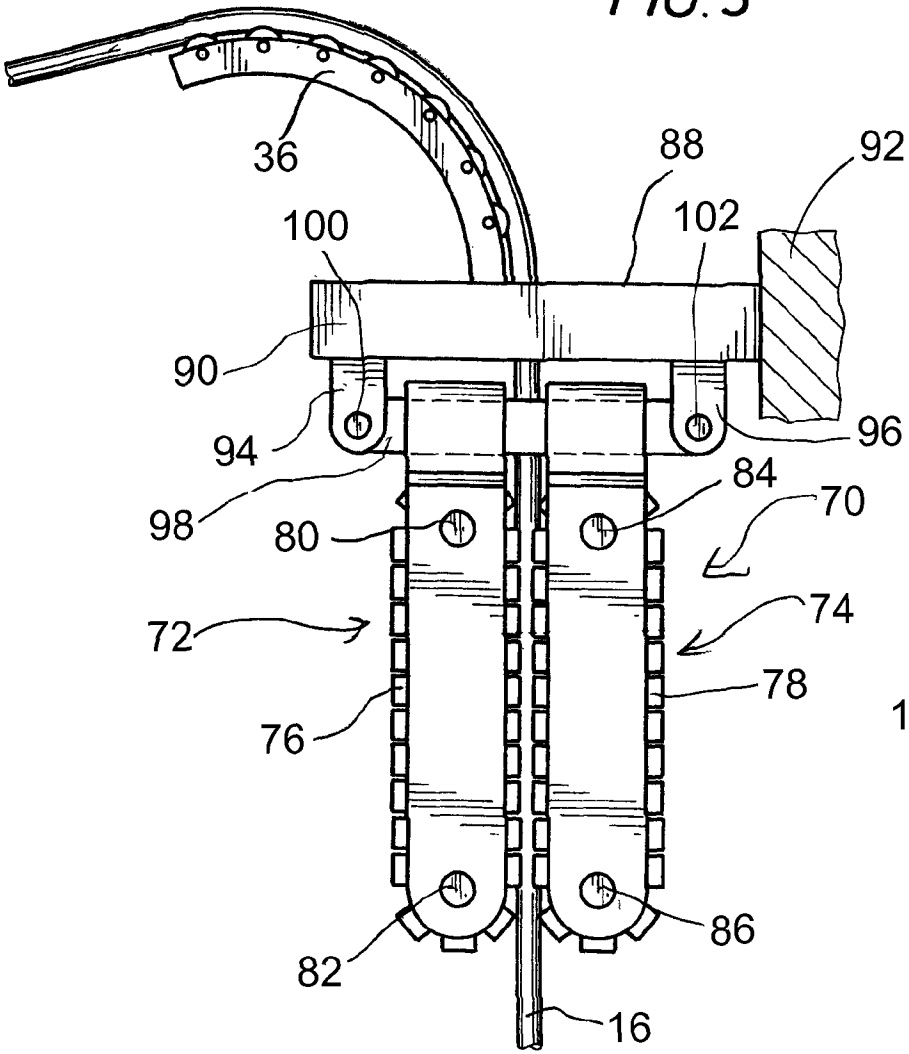
FIG. 3 is an elevational view of another embodiment of the present invention.

Referring now to FIG. 3, there is shown another embodiment of the present invention wherein the injector is top mounted as opposed to the embodiment shown in FIGS. 1 and 2, wherein the injector 10 is bottom mounted. In other words, in the embodiment shown in FIGS. 1 and 2, the injector 10 rests on the load pins, whereas in the embodiment shown in FIG. 3, the injector is suspended from the load pins.

Referring now to FIG. 3, the injector shown generally as 70 comprises first and second endless chains 72 and 74 carrying gripping blocks 76 and 78, respectively. Chain 72 is mounted on drive sprocket 80 and caller sprocket 82. In like manner, chain 70 is mounted on drive sprocket 84 and caller sprocket 86. Guide arch 36 is connected to the upper surface 88 of the mount 90, mount 90 being connected or supported by a mast, a portion of which is shown as 92. As in the case of the embodiment shown in FIGS. 1 and 2, in the embodiment shown in FIG. 3, eight eye brackets, two of which are shown as 94 and 96, are connected to mount 90. First and second beams, only one of which is shown as 98, are interconnected to mount 90 via four load pins, two of which are shown as 100 and 102 in a manner similar to that described in connection with the embodiment shown in FIGS. 1 and 2. In essence, while in the embodiment shown in FIGS. 1 and 2, injector 10 rests upon four load pins, in the embodiment shown in FIG. 3, injector 10 is suspended by four load pins.

As is well known to those skilled in the art, in general load cells utilize strain gauge technology. In the most basic form, load cells convert force into an electrical signal, which can then be converted to measure weight or force in a number of different applications. Thus, load cells can be used to measure compression, tension, bending or shear. Although the present invention has been described with particular reference to use of load measuring pins, commonly known as load pins, other types of load cells could be employed if desired albeit that mounting complexity might be increased. Thus, for example, compression load cells, tension load cells, tension and compression load cells, beam load cells, load measuring shackle, load monitoring links are all types of load cells that could be used in connection with the present invention.

Figure 4:
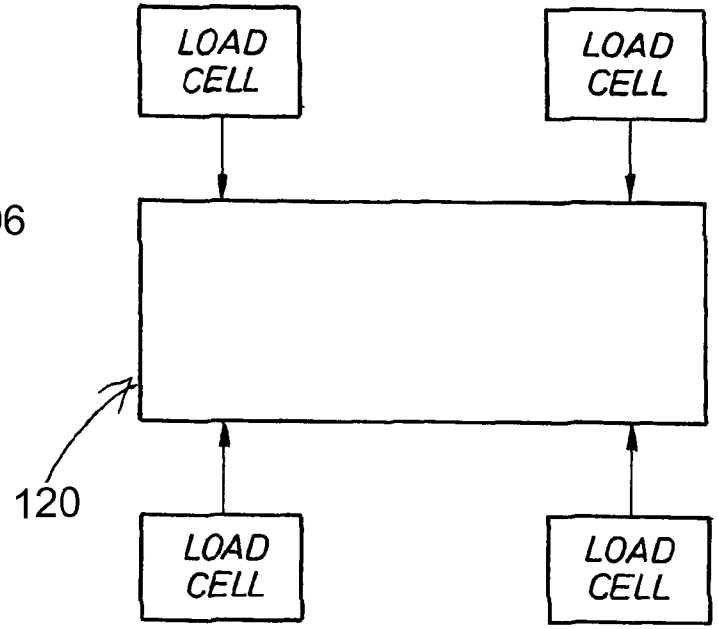
FIG. 4 is a schematic showing the use of a summing computer with the coiled tubing assembly of the present invention.

Referring now to FIG. 4, there is shown an embodiment of the present invention wherein the load cells, be it the embodiment of FIGS. 1 and 2 or the embodiment of FIG. 3, have their outputs connected to a computer, preferably a summing computer shown generally as 120. As noted above, load cells produce an electrical signal which is ultimately converted to force or weight. To accomplish this, and in the case of the present invention in the embodiment where four load cells are employed, typically the signal from each load cell would be sent to computer 120. The summing computer, or for that matter, a PLC, can determine what force or weight is being exerted on each load cell, in the case of the present invention, usually weight, which can then be summed to determine the WOB. As noted, when an injector is in use, uneven loading on the injector can occur, meaning that the load on one load cell is not the same as load on another load cell. In the case of the present invention, it would not be uncommon for the injector to be slightly canted such that the weight on the load cells on one end of the beams would be greater than the weight on the load cells on the opposite end of the beams.

In prior art coiled tubing injectors, it was common to use a single load cell in an attempt to measure WOB. However, because there are so many other forces, primarily from the guide arch and/or the coiled being guided thereby, a single load cell will not provide an accurate WOB. In the present invention, there are at least two load cells, and they are positioned between the injector mount and the injector, such that any force exerted by the guide arch and/or the coil tubing is detected and accounted for by the summing computer. For example, assume, as is shown in the preferred embodiments, there are four load cells in a generally rectangular pattern as per the embodiments described above. If it is now assumed that there is 1000 lbs. acting directly in the middle of the rectangle defined by the four load cells, each of the load cells will see 250 lbs. If the injector is now pulled 45° in the direction of the guide arch, the top left load cell; e.g., load cell 60 in FIG. 2, would show nothing, while the bottom right load cell would show 500 lbs. But the summing computer, gathering data from all the load cells, will still see 1000 lbs. Assuming that 1000 lbs. is the accurate WOB, then any force exerted by the guide arch has been taken into account, meaning the WOB measurement is correct. In effect, summing computer 120 takes an average of the readings of the four load cells in the preferred embodiment described above regardless. It will be understood that at times the coil is being pushed into the wellbore and at other times it is being pulled out. Accordingly, the WOB can be negative. At a minimum, there must be two load cells and one of them must be positioned proximal the first chain drive; e.g., chain 12 while the other load cell must be positioned proximal the other chain drive; i.e., chain 14, but not necessarily the same distance. Also, the two load cells cannot be positioned on the same side of the center line of the injector as determined by the path of the coiled tubing through the injector. It will further be understood that where only two load cells are used in the manner just described, WOB readings might not be as accurate because of the various ways the guide arch can flex, twist or swivel on the frame. However, the present invention clearly contemplates the use of two load cells positioned so as to provide a WOB measurement with any forces exerted by the guide arch being accounted for. In a more general sense, the more load cells that are employed, the more accurate the measurement. While in the preferred embodiment described above, there are four load cells in a generally rectangular pattern, it will be understood that four load cells in a diamond pattern (as viewed in plan view) or for that matter in a circular pattern (as viewed in plan view) would also work effectively. Indeed, any pattern and any number of load cells can be employed as long as the pattern is such that any forces which are not a result of WOB are detected by the load cells.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described are exemplary, and various other substitutions, alterations and modifications, including but not limited to those design alternatives specifically discussed herein, may be made in the practice of the invention without departing from its scope.

The invention claimed is:

1. A coiled tubing injector assembly having a guide arch comprising:

an injector selectively engageable with coil tubing for forcing said coil tubing therethrough in an upward or downward direction, said injector comprising first and second endless, injectors chains, said coiled tubing being positioned between said first and second chains and generally defining a centerline of said injector chains;

an injector mount;

a plurality of load cells interconnecting said injector mount and said injector, said load cells being positioned between said mount and said injector, such that any forces exerted on said injector caused by flexing or twisting of said guide arch and/or coiled tubing guided by said arch are detected by said load cells, at least one of said load cells positioned proximal said first endless injector chain on one side of said centerline and at least one of said load cells positioned proximal said second endless injector on the other side of said centerline, wherein said injector comprises a first beam, said first beam being interconnected to said mount by first and second load cells; said injector being connected to said beam.

2. The injector assembly of claim 1, wherein there is a second beam, said second beam being interconnected to said mount by third and fourth load cells.

3. The injector assembly of claim 2, wherein said first, second, third and fourth load cells are arranged in a generally rectangular pattern, coiled tubing passing through said injector defining a generally centerline of said rectangle.

4. The injector assembly of claim 1, wherein said load cells comprise load pins.

5. The injector assembly of claim 1, wherein said mount is disposed above said injector, and said injector is suspended from said mount by said load cells.

6. The tubing injector assembly of claim 1, wherein said mount is disposed below said injector, and said injector rests on said load cells.

7. The injector assembly of claim 1, further including a computer connected to said load cells for detecting signals from said load cells.

8. The injector assembly of claim 7, wherein said computer comprises a summing computer.

* * * * *